US005474178A

United States Patent [19]

DiViesti et al.

[11] Patent Number: 5,474,178

[45] Date of Patent: Dec. 12, 1995

[54] PACKAGING TRAY FOR ELECTRICAL CONNECTORS

[75] Inventors: Anthony M. DiViesti, Arlington Heights; Gordon W. Funck, Naperville, both of Ill.

[73] Assignee: Molex Incorporated, Lisle, Ill.

[21] Appl. No.: 264,399

[22] Filed: Jun. 23, 1994

[51] Int. Cl.[6] ..... B65D 73/02; B65D 1/34

[52] U.S. Cl. ..... 206/723; 206/564; 206/565; 206/728

[58] Field of Search ..... 206/328, 332, 206/334, 564, 561, 820, 557, 558, 559, 560, 562, 563, 565, 566, 567; 361/220; 211/60.1, 26

[56] References Cited

U.S. PATENT DOCUMENTS

| | | | |
|---|---|---|---|
| D. 256,976 | 11/1980 | Webster | 206/564 |
| 3,272,371 | 9/1966 | Weiner | 217/26.5 |
| 4,171,049 | 10/1979 | Nohara et al. | 206/328 |
| 4,501,363 | 2/1985 | Isbey, Jr. | 206/570 |
| 4,632,246 | 12/1986 | Brutosky | 206/328 |
| 4,671,407 | 6/1987 | Brutosky | 206/332 |
| 4,798,305 | 1/1989 | Laverty | 206/334 |
| 5,012,925 | 5/1991 | Gallagher, Sr. | 206/332 |
| 5,274,194 | 12/1993 | Belcher | 174/50 |
| 5,305,879 | 4/1994 | Noschese | 206/334 |
| 5,360,109 | 11/1994 | Janota | 206/332 |

*Primary Examiner*—Paul T. Sewell
*Assistant Examiner*—Tara L. Laster
*Attorney, Agent, or Firm*—Charles S. Cohen

[57] ABSTRACT

A tray is provided for supporting electrical connectors of the type having an elongated dielectric housing within which electrical terminals are secured. The housings can vary in length according to the size of the connectors. The tray is adaptable for supporting different sizes of connectors with housings of different lengths. The tray includes a first support for supporting adjacent ends of a plurality of the electrical connectors in a side-by-side array thereof. A second support is movably mounted on the tray to a plurality of different positions spaced from the first support for supporting opposite ends of different sizes of the connectors.

10 Claims, 3 Drawing Sheets

PACKAGING TRAY FOR ELECTRICAL CONNECTORS

FIELD OF THE INVENTION

This invention generally relates to the art of electrical connectors and, particularly, to a packaging tray for supporting electrical connectors.

BACKGROUND OF THE INVENTION

One arrangement for handling electrical connector assemblies or electrical connector components is a high density tray or magazine fabricated of a sheet of formed plastic material. For instance, a thin sheet of polyvinyl chloride is thermal formed or vacuum formed to provide a high density tray for electrical connectors. These types of trays typically are used for supporting electrical connectors of the type having an elongated dielectric housing within which electrical terminals are secured. These trays support the electrical connectors or elongated housings in a side-by-side array. For instance, the trays are used extensively with edge card connectors or SIMM connectors widely used in the connector industry.

An example of one such packaging tray of the prior art is shown in co-pending application Ser. No. 054,333, filed Apr. 28, 1993 and assigned to the assignee of the present invention. Such prior art packaging tray includes a floor, opposite side walls, a closed end defined by a rear wall and an open front end. A plurality of spaced apart rails extend upwardly from the floor and generally parallel to the side walls to define parallel channels therebetween. The side walls and rails each include a notch near the open end of the tray to receive a rod-like member in order to close the open end of the tray.

One of the problems with packaging trays of the character described above is that the overall dimensions of the trays have become somewhat standardized, but the sizes of the connectors to be supported by the trays can vary widely. Edge card connectors, for instance, are manufactured in many different circuit sizes and, thus, many different lengths. For any standard size tray, connectors of certain sizes (i.e., lengths) will fill the tray in a relatively efficient manner with very little open area. Other size connectors, however, will result in large open areas in the trays which results in very inefficient use of space. In addition, different lengths of connectors will have different centers of gravity. Thus, different length connectors require support at different locations.

The present invention is directed to solving these problems by providing a tray which is adaptable for supporting different sizes of connectors with housings of different lengths.

SUMMARY OF THE INVENTION

An object, therefore, of the invention is to provide a new and improved packaging tray for supporting electrical connectors.

In the exemplary embodiment of the invention, the tray is designed for supporting electrical connectors of the type having an elongated dielectric housing within which electrical terminals are secured. The housings of the connectors can vary in length according to the size of the connectors. The invention contemplates that the tray be adaptable for supporting different sizes of connectors with housings of different lengths.

The tray includes a frame provided by a sheet of formed plastic material having a floor with first support means thereon for supporting adjacent ends of a plurality of the electrical connectors in a side-by-side array thereof. Second support means are movably mounted on the tray to a plurality of different positions spaced from the first support means for supporting opposite ends of different sizes of the connectors.

As disclosed herein, the sheet of formed plastic material includes side walls extending generally parallel to and on opposite sides of the connectors in their side-by-side array. Generally, the second support means span the side walls. Specifically, the side walls include a plurality of receptacles, such as notches, spaced lengthwise of the connectors for removably receiving the second support means at the different positions. In the preferred embodiment, the second support means comprise at least one rod, such as a plastic straw, for removably positioning in the notches of the side walls.

Another feature of the invention is the provision of hold-down means mountable on the tray above the connectors to hold the connectors on the first and second support means. As disclosed herein, the hold-down means comprise one or more rods or plastic straws positionable into receptacles or notches in the side walls of the tray.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
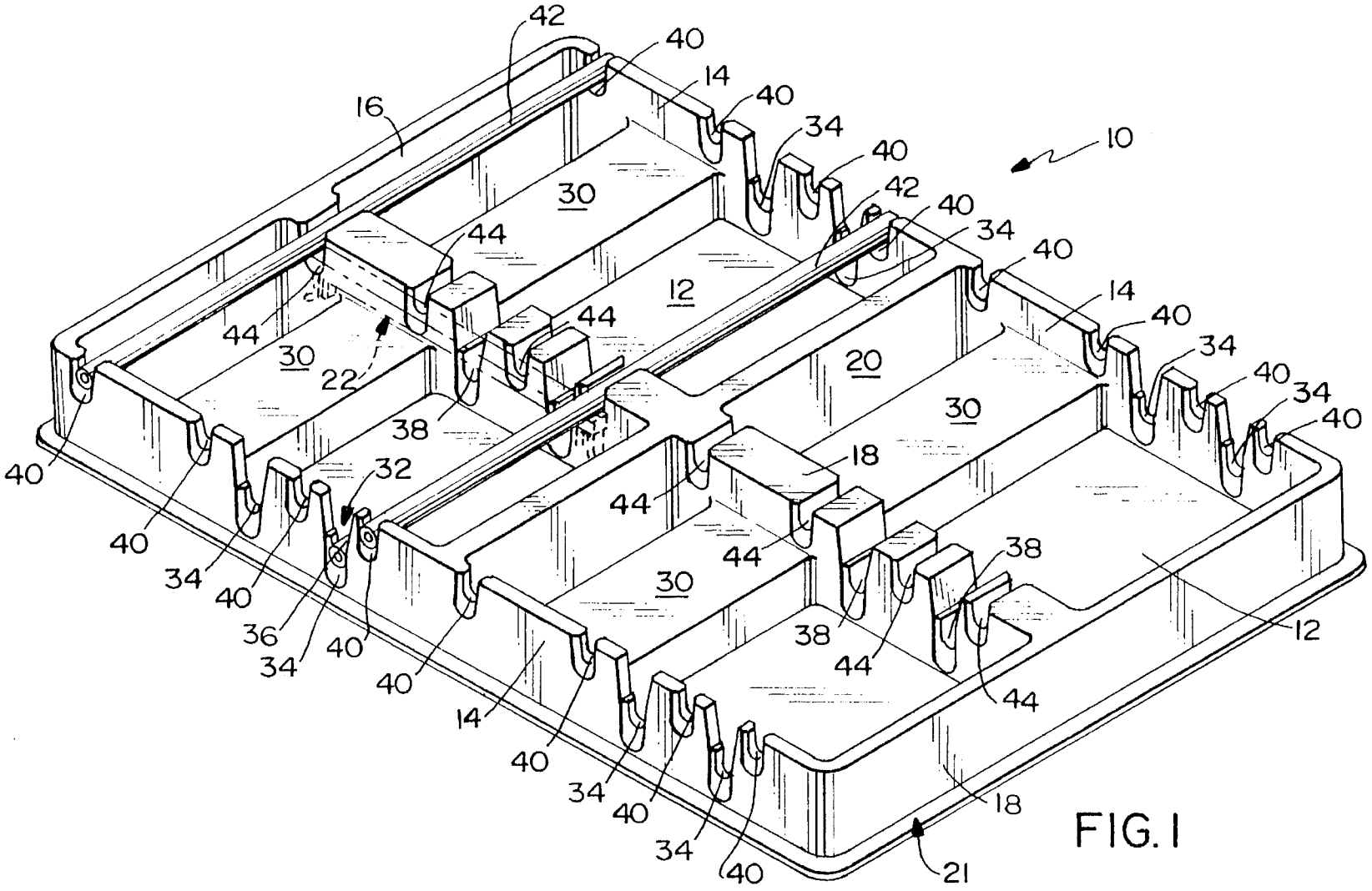
FIG. 1 is a perspective view of a packaging tray embodying the concepts of the invention.
Figure 2:
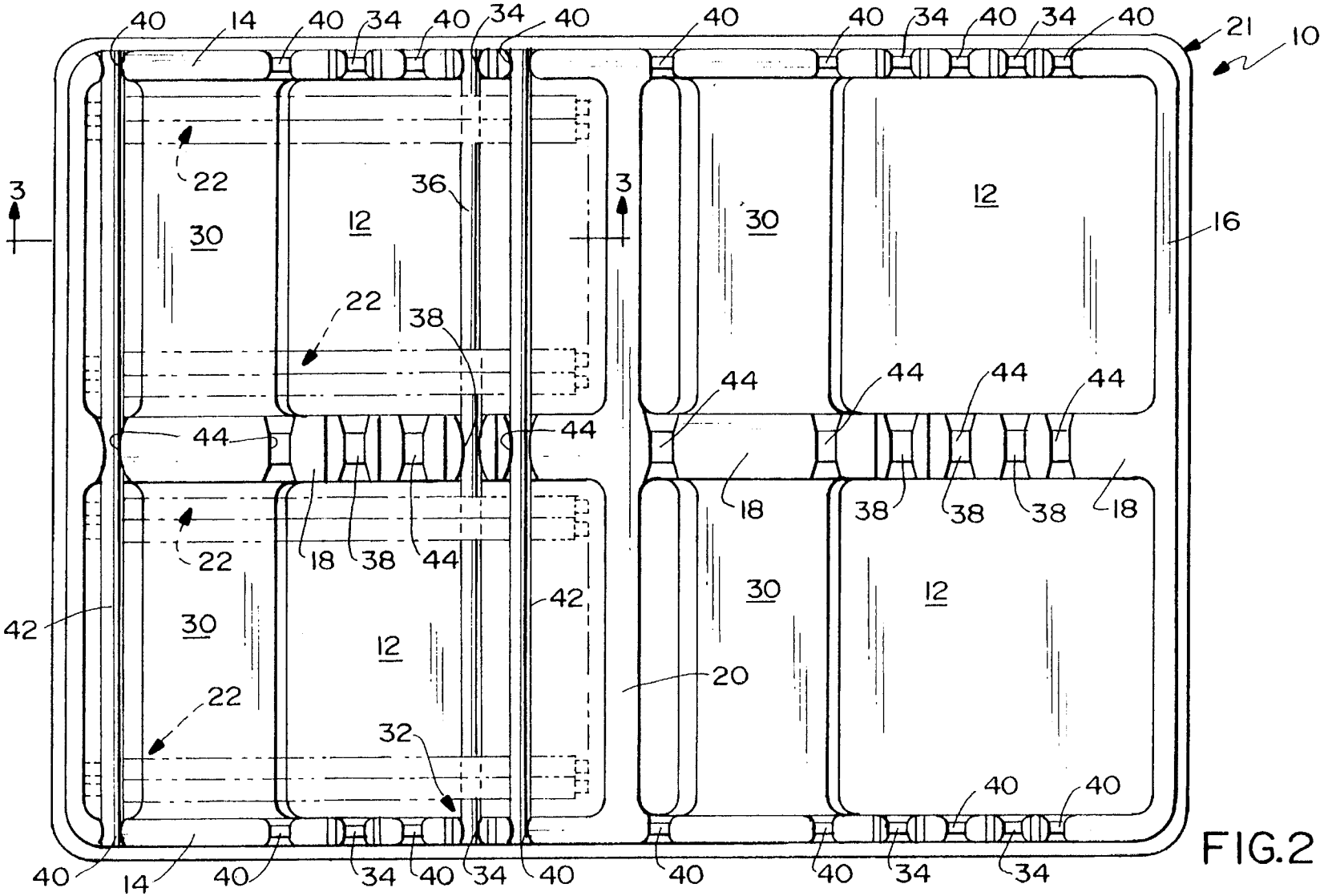
FIG. 2 is a top plan view of the tray.

Referring to the drawings in greater detail, and first to FIGS. 1 and 2, the invention is incorporated in a packaging tray, generally designated 10, which includes a floor 12, opposite side walls 14, opposite end walls 16, and a longitudinal dividing wall 18 and cross dividing wall 20 that divide the tray into four quadrants as shown. The entire tray, including the floor, the side walls, the end walls, the longitudinal dividing wall and the cross dividing wall, define a frame fabricated of a single sheet, generally designated 21, of formed plastic material. The sheet may be thin polyvinyl chloride which is vacuum formed.

Figure 3:
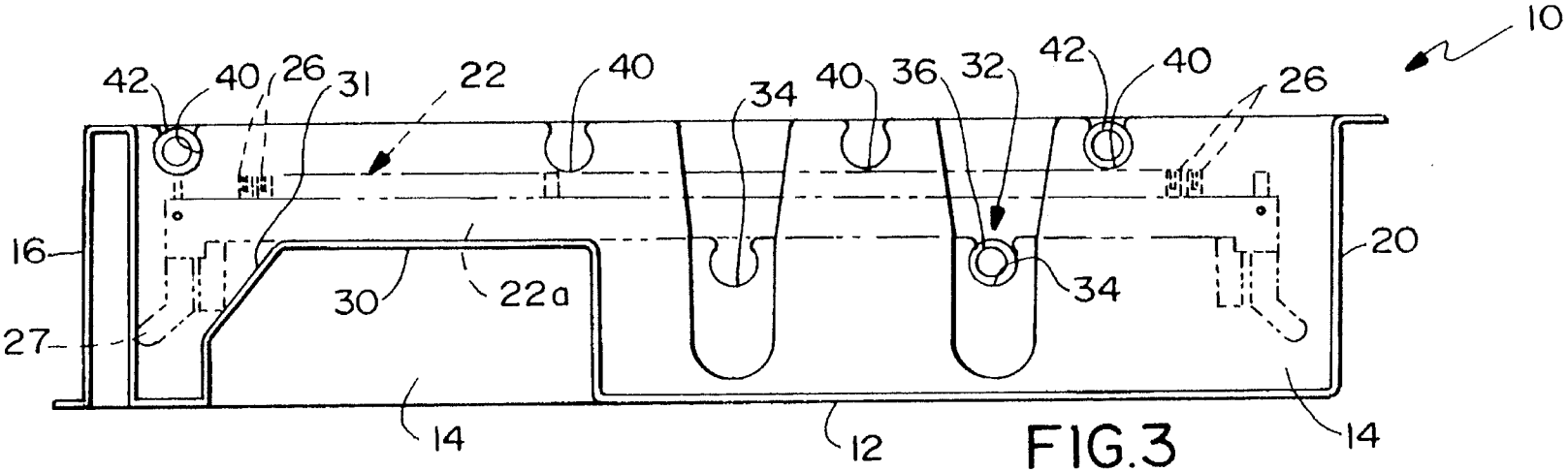
FIG. 3 is a vertical section taken generally along line 3—3 of FIG. 2.
Figure 4:
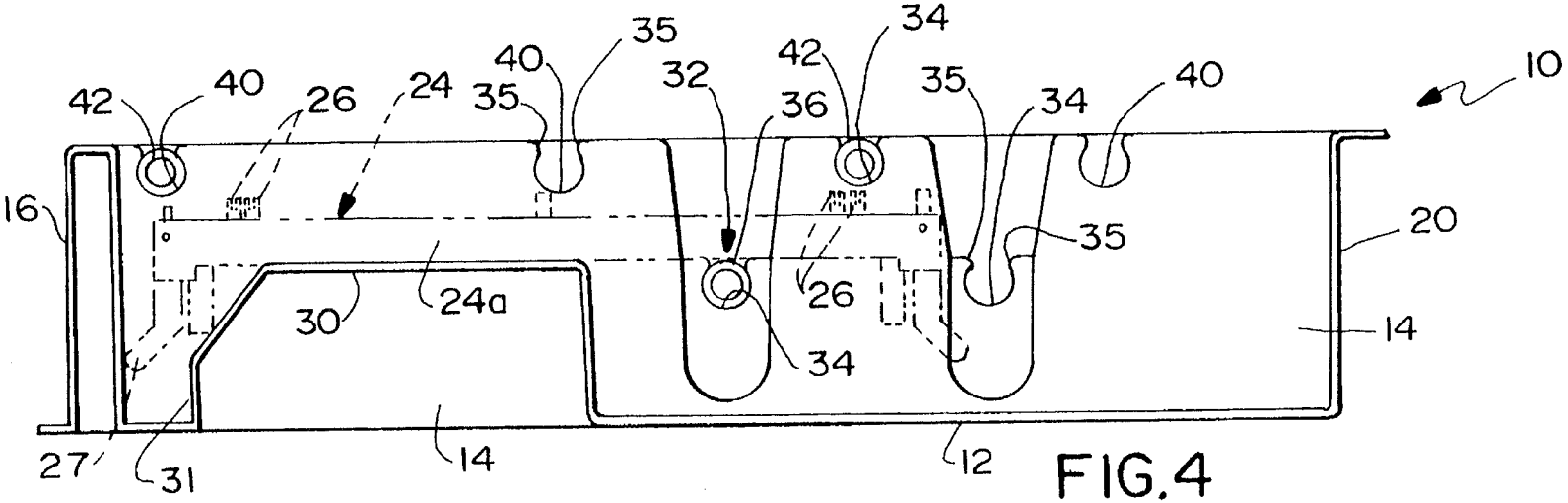
FIG. 4 is a view similar to that of FIG. 3, with the tray adjusted to support smaller/shorter connectors than the condition of the tray in FIGS. 1–3.

The invention contemplates that tray 10 is adaptable for supporting different sizes of electrical connectors with housings of different lengths. A typical electrical connector which is quite applicable for packaging in tray 10 is an edge card or SIMM connector. Referring to FIGS. 3 and 4, two different lengths of connectors are shown in phantom in these depictions. Specifically, a longer connector, generally designated 22, is supported by the tray in FIG. 3, but a shorter connector, generally designated 24, is supported by the tray in FIG. 4. Actually, FIGS. 3 and 4 show only one-half (the left half of FIGS. 1 and 2) of tray 10. Therefore, it should be understood that the following description is applicable also to the other or right half of the tray.

Either connector 22 or 24 is shown as an edge card connector having an elongated dielectric housing 22*a* and 24*a*, respectively. A rotatable eject latch 27 may be provided at either or both ends of the housing and extends substantially above the body of the housing. The housings secure terminals 26 therewithin. The "size" of such a connector is determined by the number of circuits and, therefore, the number of terminals mounted by the connector housing. Therefore, a longer housing is required to secure a larger number of terminals which results in a longer connector for accommodating more circuits. The tray of this invention is adjustable or adaptable for supporting different sizes of such elongated connectors.

More particularly, a first support member 30 is provided for supporting adjacent ends of a plurality of the electrical connectors in a side-by-side array thereof. Actually, the first support member is provided by an integral elevated portion of floor 12. FIG. 2 best shows how the adjacent ends of side-by-side arrays of the longer connectors 22 are arranged in each quadrant of the tray. FIG. 3 best shows how the elevated portions of floor 12 provide the first support member 30 for supporting adjacent ends of the side-by-side arrays of connectors.

Second support means, generally designated 32, is provided for supporting the opposite end of the connectors. Generally, the second support means is selectively removably mountable on the tray in a plurality of different positions spaced from first support member 30 for supporting the opposite end of different sizes of the connectors.

More particularly, second support means 32 includes two receptacles or notches 34 integrally formed in side walls 14 at a position slightly below the top of first support member 30 for receiving at least one rod-like support member 36. The rod-like support member may be provided by a plastic straw-like member. Longitudinal divider wall 18 also is provided with a plurality of receptacles or notches 38 at the same height for accommodating support straw 36 whereby a single support straw can span the entire width of the tray between opposite side walls 14. The upper edges of notches 34 and 38 include projections 35 that extend toward the center of the notch in order to provide a region of reduced area. The straw is forced past these projections and retained within the notches by the projections.

Looking at FIG. 3, it can be seen that the first support member is provided by elevated portion 30 of floor 12 for supporting adjacent ends of electrical connectors 22. The second support means 32 is provided by support straw 36 being positioned in the right-hand notches 34 with the top of support straw 36 being generally the same height as first support member 30 to support the opposite ends of the connectors.

In order to support shorter connectors 24, reference is made to FIG. 4 wherein it can be seen that support straw 36 has been moved to the left-hand notches 34 in side walls 14 (i.e., closer to first support member 30). Therefore, while the first support means or elevated portions 30 of floor 12 again support adjacent ends of the side-by-side array of shorter connectors 24, support straw 36 has been moved to a different position for supporting the opposite ends of the shorter connectors.

Placement of the support straw 36 is generally determined by the center of gravity of the connector. The closer the support straw is positioned to the end of the connector, the more stable the connector will be within the tray.

Generally, the invention also contemplates hold-down means mountable on tray 10 above connectors 22 or 24 to hold the connectors on first support member 30 and support straw 36. More particularly, side walls 14 of tray 10 are provided with four receptacles or notches 40 for receiving one or more rod-like hold-down members 42. The hold-down members may be provided by plastic straw-like members similar to support straw 36. Longitudinal divider wall 18 is provided with four notches 44 for accommodating hold-down straws 42 whereby the straws can span the entire width of the tray between opposite side walls 14. Such notches 40 are identical to notches 34 except that they are positioned so that the bottom of straws 42 contact the bottom of the connector.

Referring to FIGS. 1–3, it clearly can be seen that two hold-down straws 42 are provided in the extreme outer two notches 40 near opposite ends of longer connectors 22. However, in comparing FIG. 4, it can be seen that the right-hand hold-down straw 42 has been moved one notch to the left so that the straw is located above the opposite ends of the shorter electrical connectors 24.

As best seen in FIG. 3–4, the eject latches 27 project above the top surface of the connector. Accordingly, when the connectors are inverted as shown in FIGS. 3–4, a recess 31 between endwall 16 and first support member 30 must be provided to receive such eject latches. In the alternative, the first support member as shown herein could be replaced with notches and a straw-like member to support the housing.

While a variety of tray configurations, different numbers of support straws 36 and their respective notches 34 and different numbers of hold-down straws 42 and their respective notches 40 are contemplated by the invention, the preferred embodiment has proven very effective with contemporary edge card or SIMM connectors presently used in the electronic industry. In other words, by providing two notches 34 in the positions shown for removably receiving support straw 36 at two different positions, and by providing four notches 40 in the locations shown for receiving two hold-down straws 42, most sizes (lengths) of edge card or SIMM connectors presently used in the industry can be accommodated by tray 10 of the invention.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A tray for supporting electrical connectors of the type having an elongated dielectric housing within which electrical terminals are secured, wherein the housings can vary in length according to the size of the connectors, the tray being adaptable for supporting connectors with housings of different lengths, comprising:

a sheet of formed plastic material having a floor with a first support projection extending upward therefrom for engaging and supporting adjacent ends of a plurality of said electrical connectors in a side-by-side array thereof above said floor;

said sheet of formed plastic material further including side walls extending generally parallel to and on opposite sides of the connectors in said side-by-side array thereof, a second support member selectively removably mountable on the tray at a plurality of different positions spaced from said first support means for engaging and supporting opposite ends of different sizes of said connectors above said floor, said second support member spanning the side walls; and said side walls including a plurality of receptacles spaced lengthwise of the connectors for removably receiving the second support member at said different positions, said receptacles comprise notches, and said second support member comprises a plastic hollow tube member.

2. The tray of claim 1 wherein said electrical connectors include a generally planar upper surface and an upstanding member extending substantially above said upper surface, and said first support projection is adapted to contact and support said generally planar upper surface and said tray further includes a recess for receiving said upstanding member therein.

3. The tray of claim 1 wherein said first support projection is integrally molded from said sheet of plastic material.

4. A tray for supporting electrical connectors of the type having an elongated dielectric housing within which electrical terminals are secured, wherein the housings can vary in length according to the size of the connectors, the tray being adaptable for supporting connectors with housings of different lengths, comprising:

a sheet of formed plastic material having a floor with a first support projection extending upward therefrom for engaging and supporting adjacent ends of a plurality of said electrical connectors in a side-by-side array thereof above said floor;

a second support member selectively removably mountable on the tray at a plurality of different positions spaced from said first support means for engaging and supporting opposite ends of different sizes of said connectors above said floor; and a plurality of hold-down members mountable on the tray above the connectors to hold the connectors on the first support projection and the second support member, said hold-down members and said second support member being substantially identical.

5. The tray of claim 4 wherein said sheet of formed plastic material includes side walls extending generally parallel to and on opposite sides of the connectors in said side-by-side array thereof, and said sidewalls further include a plurality of first receptacles for removably receiving the second support member at said different positions and a plurality of second receptacles for removably receiving the hold-down members at different positions, said first and second receptacles receiving said second support member and said plurality of hold-down members, respectively, at different heights above said floor.

6. The tray of claim 5 wherein said receptacles comprises notches, and said second support member and said plurality of hold-down members are rods.

7. The tray of claim 6 wherein said rods are plastic hollow tube members.

8. A tray adaptable for supporting a plurality of electrical connectors of different lengths, comprising:

a frame including a floor and opposite side walls projecting upwardly from the floor;

a first support member elevated above the floor and upon which adjacent ends of said plurality of said electrical connectors are positioned in a side-by-side array;

a plurality of first receptacles spaced along the side walls lengthwise of the connectors;

a second support member removably receivable in the first receptacles at a plurality of different positions spaced from said first support member and upon which opposite ends of said connectors are positioned;

a plurality of second receptacles spaced along the side walls lengthwise of the connectors; and a plurality of hold-down members removably receivable in the second receptacles at a plurality of different positions to hold the connectors on said first support member and said second support member, the distance between said hold-down members and said floor being greater than the distance between said second support member and said floor.

9. The tray of claim 8 wherein said receptacles comprise notches, and said second support member is rod-like support member.

10. The tray of claim 8 wherein said electrical connectors include a generally planar upper surface and an upstanding member extending substantially above said upper surface, and said first support member is adapted to contact and support said generally planar upper surface and said tray further includes a recess for receiving said upstanding member therein.

* * * * *